US010465885B2

(12) United States Patent
Gantenbrink et al.

(10) Patent No.: US 10,465,885 B2
(45) Date of Patent: Nov. 5, 2019

(54) FASTENING SYSTEM FOR LUMINAIRES, IN PARTICULAR FOR RECESSED CEILING AND WALL LUMINAIRES

(71) Applicant: Glashütte Limburg Leuchten GmbH + Co. KG, Limburg (DE)

(72) Inventors: Heinrich J. Gantenbrink, Menden (DE); Thomas Schneider, Runkel (DE)

(73) Assignee: Glashütte Limburg Leuchten GmbH + Co. KG, Limburg (DE)

( * ) Notice: Subject to any disclaimer, the term of this patent is extended or adjusted under 35 U.S.C. 154(b) by 101 days.

(21) Appl. No.: 15/870,637

(22) Filed: Jan. 12, 2018

(65) Prior Publication Data

US 2018/0216805 A1 Aug. 2, 2018

(30) Foreign Application Priority Data

Jan. 31, 2017 (EP) ..... 17153967

(51) Int. Cl.
*F21V 21/04* (2006.01)
*F21V 17/02* (2006.01)
(Continued)

(52) U.S. Cl.
CPC ..... *F21V 21/047* (2013.01); *F21S 8/026* (2013.01); *F21V 17/02* (2013.01); *F21V 19/047* (2013.01);
(Continued)

(58) Field of Classification Search
CPC ..... F21V 21/047; F21V 21/045; F21V 21/14; F21V 19/047; F21V 29/763; F21V 17/02; F21V 23/009; F21S 8/026
See application file for complete search history.

(56) References Cited

U.S. PATENT DOCUMENTS 5,738,436 A * 4/1998 Cummings ..... F21S 8/026 362/294
2008/0002414 A1* 1/2008 Miletich ..... F21S 8/02 362/382
(Continued)

FOREIGN PATENT DOCUMENTS

DE 92 178 71 U1 4/1993
DE 93 17 087 U1 1/1994
(Continued)

*Primary Examiner* — David V Bruce
(74) *Attorney, Agent, or Firm* — Baker & Hostetler LLP

(57) ABSTRACT

An assembly set for recessed ceiling and wall luminaires, comprises a mounting sleeve and a luminaire housing, which is adapted to be installed in the mounting sleeve, the mounting sleeve being mountable in a wall or ceiling opening. The mounting sleeve is provided with contact portions extending, on the side of the mounting sleeve facing away from the wall or ceiling opening, perpendicular to a wall of the mounting sleeve into the interior of the latter. The luminaire housing comprises at least two locking elements extending beyond the circumference of the luminaire housing, wherein the locking elements of the luminaire housing engage behind the contact portions of the mounting sleeve at the fixing position, and the locking elements are operatively connected to handles in the interior of the luminaire housing such that the locking elements can be transferred from the fixing position to a release position by moving the handles towards each other.

22 Claims, 4 Drawing Sheets

(51) Int. Cl.

| | |
|---|---|
| ***F21V 23/00*** | (2015.01) |
| ***F21S 8/02*** | (2006.01) |
| ***F21V 29/76*** | (2015.01) |
| ***F21V 19/04*** | (2006.01) |
| *F21V 21/14* | (2006.01) |

(52) U.S. Cl.
CPC ..... *F21V 21/045* (2013.01); *F21V 23/009* (2013.01); *F21V 29/763* (2015.01); *F21V 21/14* (2013.01)

(56) References Cited

U.S. PATENT DOCUMENTS

| | | | | |
|---|---|---|---|---|
| 2015/0345761 | A1* | 12/2015 | Lawlor | F21V 21/14 362/364 |
| 2017/0284643 | A1* | 10/2017 | Coakley | F21V 21/14 |

FOREIGN PATENT DOCUMENTS

| | | | |
|---|---|---|---|
| DE | 10 2004 058 241 | A1 | 6/2006 |
| DE | 10 2005 032 265 | A1 | 1/2007 |
| DE | 10 2014 205 663 | A1 | 10/2015 |
| WO | 2015/075599 | A2 | 5/2015 |

* cited by examiner

FASTENING SYSTEM FOR LUMINAIRES, IN PARTICULAR FOR RECESSED CEILING AND WALL LUMINAIRES

CROSS-REFERENCE TO RELATED APPLICATION

This application claims priority to foreign European patent application No. EP 17 153 967.9, filed on Jan. 31, 2017, the disclosure of which is incorporated by reference in its entirety.

FIELD OF THE INVENTION

The present invention relates to an assembly set for recessed ceiling and wall luminaires, comprising a mounting sleeve and a luminaire housing, which is adapted to be installed in the mounting sleeve, said mounting sleeve being mountable in a wall or ceiling opening.

BACKGROUND

A characteristic feature of recessed ceiling and wall luminaires is that essential parts of the luminaire housing extend into the building structure and are arranged within a wall, a floor or a ceiling. Normally, only the front face of the luminaire projects into the room or is flush with the surface delimiting it.

In this context, a great variety of different ways of mounting such luminaires in the building structures is known. Luminaires of the type in question may, for example, have an edge which projects beyond the installation opening, the luminaire being drawn into the installation opening through spring or screw elements. The provided edge is thus in firm contact with the surface of the building structure, whereby the luminaire is fixed in position.

When these kinds of mounting are used, a carrier element is often fixedly connected to the building structure. In the case of drywalls, this can be done by screw-fastening or plastering-in the parts. In the resultant installation opening, the carrier element then provides fastening possibilities for the luminaire to be installed. The latter may e.g. be fixed in position by screw fastening. Other possibilities are e.g. the use of springs or connection elements of a more or less intricate structural design. In this respect, it will often be necessary that the orientation of the luminaire relative to the building structure must already be taken into account during mounting of the carrier element.

DE 10 2004 058 241 A1 discloses a luminaire including a cylindrical housing configured for ceiling plaster installation, said cylindrical housing having provided therein a carrier means for a lamp, which is supported such that it is rotatable and pivotable relative to the housing. Within the carrier member, a fixedly or releasably attached reflector is provided. The carrier member is held within the housing via an intermediate ring thus allowing the pivotal movements of the carrier member. For fastening the intermediate ring in the housing, the outer wall of the intermediate ring has provided therein coupling elements, which cooperate with a guide and holding unit provided in the wall of the housing. These guide and holding units may e.g. be a circumferentially extending housing groove, and the coupling means may e.g. be ball catches, which are spring biased so as to allow a snap-fit connection. Due to the snap-fit coupling between the housing and the intermediate ring, the carrier member can, together with the intermediate ring, be installed in the housing and removed therefrom as a unit without making use of any tools.

DE 92 178 71 U1 discloses a recessed luminaire, in particular for fast and easy installation in walls, ceilings or the like. To this end, the luminaire can exclusively be mounted from one side of the installation surface by plug-in-type insertion into the opening while establishing a snap-fit connection between the luminaire and the opening. Hence, no separate flush-mounting box is provided, but the snap-in connection of the luminaire clasps the ceiling or wall element from above and from below, the connection being here accomplished by a resiliently deflectable snap-in element with snap-in projections and said snap-in projections engaging the inner edge of the opening.

Also WO 2015 075 599 A2 describes a recessed luminaire. In this case, an outer housing of the luminaire body is held in an opening by means of a retaining ring. The retaining ring is provided with a retaining device engaging the outer side of the luminaire body. To this end, the outer side of the luminaire body is provided with a patterned surface having in particular a wave or ripple structure. This structure is engaged by a spherical coupling element of the retaining ring, said coupling element being provided with a spring element, so as to guarantee locking engagement with the housing of the luminaire body. The spring element also allows easy removal of the luminaire body from the opening.

DE 93 17 087 U1 relates to a recessed luminaire with an installation ring for fastening in a wall or ceiling aperture, comprising a cup-shaped reflector, which is open at one end thereof and into which at least one lamp projects. In the opening, a removable insert is fixed in position by a snap-fit device. The snap-fit device is here provided on the installation ring, said installation ring being, on the one hand, supported below the ceiling, i.e. adjoining to the opening of the lamp, whereas the other end is supported in the area of the lamp.

DE 10 2005 032 265 B4 discloses a luminaire comprising at least two luminaire components, which are adapted to be locked to and released from one another. A luminaire housing is here fixed in position via an installation ring mounted in a suspended ceiling. The connection between the intermediate ring and the luminaire housing is established via a snap-in connection, which can be engaged easily and released without making use of any tools. For this purpose, a spring element is provided, which, during insertion of the luminaire housing into the already mounted installation ring, moves past the installation ring, whereupon, above a projection of the installation ring, a barb of the spring element bounces outwards thus locking the housing in position.

This prior art clearly shows that there is a great variety of different systems for mounting luminaires of the type in question, the respective systems being based on different installation systems. It is often difficult to adapt the respective kinds of mounting to the structural conditions, e.g. to the thickness of the drywall boards used.

It is the object of the present invention to simplify mounting of recessed luminaires of the type in question and to render such mounting more uniform.

SUMMARY OF THE INVENTION

The object of the present invention is achieved by an assembly set for recessed ceiling and wall luminaires, comprising a mounting sleeve and a luminaire housing, which is adapted to be installed in the mounting sleeve, said mounting sleeve being mountable in a wall or ceiling opening, the mounting sleeve being provided with contact portions extending, on the side of the mounting sleeve facing away from the wall or ceiling opening, perpendicular to a wall of said mounting sleeve into the interior of the latter, the luminaire housing comprising at least two locking elements extending beyond the circumference of the luminaire housing, wherein the locking elements of the luminaire housing engage behind the contact portions of the mounting sleeve at the fixing position, and the locking elements are operatively connected to handles in the interior of the luminaire housing such that the locking elements can be transferred from the fixing position to a release position by moving the handles towards each other.

It follows that the present invention provides a universal assembly set, which, making use of a great variety of mounting means, can be mounted in a building structure. According to requirements, the mounting sleeve may here be used for mounting in round openings of drywall elements, frameless mounting in drywall ceilings or in cast walls, floors or ceilings. The subsequent arrangement of the luminaire housing within the mounting sleeve, which is configured according to requirements, takes place in an identical manner, so that the number of components required will be reduced substantially, since only a single form of luminaire housing will be necessary. This leads to a substantial reduction of storage costs.

The provision of handles within the luminaire housing makes the fixing of the luminaire housing within the mounting sleeve much easier, since the luminaire housing can easily be introduced in and fixed to the mounting sleeve without any additional tools being necessary. The locking elements of the luminaire housing are here manually moved towards one another, whereby the locking elements are transferred from a fixing position to a release position. In this condition, the luminaire housing can be introduced in the mounting sleeve easily and unhindered. When the handles are released, the locking elements return to their fixing position, and the luminaire housing is reliably fixed to the mounting sleeve. This kind of fixing has, on the one hand, a positive effect on the first mounting operation of the assembly set and, on the other hand, it will also make it easier for the future user to replace the luminaire housing by another one, e.g. in the case of defects.

Furthermore, the fixing of the luminaire housing in the area of a contact portion by means of the locking elements provided establishes an efficient connection of the two elements, said connection being limited to a minimum of movable parts, so that the individual elements of the assembly set can be produced at a reasonable price.

According to a preferred embodiment, the locking elements may be arranged displaceably in the luminaire housing. This guarantees a particularly easy transfer of the locking elements from the fixing position to the release position and vice versa.

According to another embodiment, the luminaire housing may comprise a circumferentially extending wall portion as well as a cover portion, said cover portion extending beyond the wall portion thus forming a support portion, and lateral openings being formed in the area of the cover portion at a predetermined distance from the support portion, the locking elements, when occupying the fixing position, extending through said lateral openings, at least sectionwise. The support portion provides here an element that is in abutting contact with the contact portion thus defining a firm fixing position. In this way, the luminaire housing can be introduced in the mounting sleeve without any additional positioning aid, whereby mounting is substantially simplified.

The predetermined distance between the support portion and the lateral opening may here correspond to the thickness of the contact portion of the mounting sleeve. Since the predetermined distance corresponds to the thickness of the contact portion, it is guaranteed that the locking element extending through the lateral opening will be arranged above the contact portion and that the latter will thus be fixed between the support portion and the locking element.

According to another preferred embodiment, an upper sliding aperture is formed for each locking element in the area of the cover portion, each locking element comprising a sliding section, which extends from inside through the sliding aperture to the outside of the cover portion. The combination of sliding aperture and sliding section serves to fix and guide the locking element in the area of the cover portion.

The sliding section may here be configured as a T-shaped element on the side of the locking element located opposite to the handles, said T-shaped element comprising a web element and sliding fingers extending away from the web element on both sides thereof in an upper area of the web element. When the sliding section is passed through the sliding opening provided in the cover portion, the web element will be located substantially within the cover portion, whereas the sliding fingers will already be arranged outside the cover portion, so that they can rest on the outer side or upper side of the cover portion.

According to a preferred embodiment, the sliding apertures are formed at a position close to the center of the cover portion in the form of a passage opening and extend in the direction of an outer edge of the cover portion as a slide channel. This embodiment guarantees that the sliding sections can be passed through the cover portion and will subsequently provide reliable guidance of the locking element in the area of the cover portion. To this end, the passage opening is configured such that it substantially corresponds to the top view of the sliding section, i.e. it corresponds to the shape of the combination of sliding finger and web. Since the passage opening subsequently continues in the form of a slide channel, it is guaranteed that the sliding fingers will rest on the outer surface of the cover portion and that the locking element will thus be held from outside.

The position of the passage opening in the cover portion corresponds approximately to the release position of the locking element.

The movement of the locking element between the fixing position and the release position will be guided in a defined manner, when the sliding fingers are displaceably arranged on either side of the slide channel on the outer side of the cover portion. Thus, a predetermined path of movement of the locking element is given, and the movement will thus be carried out in a defined and clear manner. This will especially be guaranteed, when the width of the slide channel substantially corresponds to the width of the sliding section web.

According to another preferred embodiment, it proved to be useful when sliding recesses for the locking elements are formed on the inner side of the cover portion, and when the locking elements are movable between the fixing position and the release position in said sliding recesses. These sliding recesses are preferably configured as depressions, and the shape of the depressions may substantially correspond to the contour of the upper side of the locking elements. The slide channel may here be arranged centrally in said sliding recess, so as to provide additional guidance, so that each locking element will be held in the area of the cover portion between the sliding recess and the sliding fingers. This arrangement defines the movement of the locking element in an unequivocal manner and prevents the locking element from getting stuck or from being slowed down in its movement.

In this respect it proved to be particularly useful, when the depth of the recesses corresponds to the height of the lateral openings, i.e. the lateral opening is fully accessible from the recess. While changing from the release position to the fixing position, the locking element according to this embodiment can simply exit through the lateral opening, and will then, at the mounting position, abut above the contact portion of the mounting sleeve.

According to a specially preferred embodiment, the areas of each locking element extending through the lateral opening may be wedge-shaped, the surface facing the support edge extending at an oblique angle upwards in the direction of an outer edge of the locking element. According to the wedge principle, an axial force can thus be applied to the contact portion of the mounting sleeve.

According to another preferred embodiment, a downwardly extending stop shoulder follows the wedge-shaped area of the locking element, said stop shoulder being adapted to be brought into abutting contact with the inner side of the luminaire housing below the lateral opening. The stop shoulder extends substantially perpendicularly downwards and defines the length of the locking element portion that is allowed to exit through the lateral opening. Thus, it is guaranteed that the locking element cannot be moved out of the luminaire housing to an arbitrary extent.

According to still another embodiment, each locking element may be biased at the fixing position. Hence, the locking element is forced into the outermost position, and prevents unintentional demounting of the locking elements.

The locking element may here be biased via a spring element. The use of a spring element provides a particularly simple element by means of which also the transfer to the release position can be carried out without taking any additional measures.

It proved to be useful when each locking element has, on the surfaces facing each other, accommodation sections for fully accommodating therein the spring element in the compressed condition and for partially accommodating therein the spring element in the relaxed condition. Accommodation sections of the type in question may especially be configured as a blind hole. Since the spring can, in the compressed condition, be fully accommodated in the locking element, i.e. in the blind hole, it can be introduced in the luminaire housing together with the locking element. Preferably, means will here be used, which prevent release of the spring. Only when the locking element has been inserted in the luminaire housing, these means will be removed and the spiral spring will be able to expand.

According to another embodiment, the width of each locking element may increase in the direction of the inner side of the luminaire housing. This embodiment is especially used for adapting the locking element to the circular shape of the luminaire housing, so that the locking element portion exiting through the lateral opening to the outside will be as broad as possible, in order to apply the highest possible fixing force to the contact portion of the mounting sleeve.

In practice, it turned out to be particularly useful when two locking elements are provided. This number proved to be sufficient for guaranteeing reliable fixing, so that the number of movable parts can be reduced to a minimum.

According to a further preferred embodiment, those areas of the contact portion of the mounting sleeve and of the support portion of the luminaire housing which are arranged one on top of the other in the assembled condition may be provided with teeth. By means of suitable teeth, the rotation of the luminaire during mounting can be determined such that fixed angular steps will be executed. When the locking elements have been transferred to the fixing position, further rotation of the luminaire will no longer be possible, so that the luminaire is here fixed at its final position. Suitable teeth may, however, also be configured as an additional element.

According to still another embodiment, a sealing element may be arranged between those areas of the contact portion of the mounting sleeve and of the support portion of the luminaire housing which are arranged one on top of the other in the assembled condition. If an assembly set according to the present invention is used e.g. in a floor, an ingress of water can be prevented by the use of a sealing. The sealing pressure is here created either during the insertion process through frictional pressure between the luminaire housing and the mounting sleeve, or an axial pressure is created between the sealing and the locking elements.

According to another preferred embodiment, the mounting sleeve may be provided with additional elements, selected from mounting elements and/or an external thread, on its outer side, in particular on the side of the outer side facing a building structure. Hence, the mounting sleeve can be adapted to the respective mounting conditions. For example, when the mounting sleeve is used in cast walls, floors or ceilings, the external thread may cooperate with an internal thread, so as to change the position of the mounting sleeve in an arbitrary manner. A corresponding external thread may, however, also be used in the case of easy mounting, where the mounting sleeve can be adjusted in a suitable manner to the respective thickness of the drywall.

A method according to the present invention, used for fixing an assembly set for recessed ceiling and wall luminaires in a wall or ceiling opening, wherein the assembly comprises a mounting sleeve and a luminaire housing, which is adapted to be installed in the mounting sleeve, the mounting sleeve is provided with contact portions extending, on the side of the mounting sleeve facing away from the wall or ceiling opening, perpendicular to the wall of said mounting sleeve into the interior of the latter, the luminaire housing comprises at least two locking elements which extend beyond the circumference of the luminaire housing and which are operatively connected to handles in the interior of the luminaire housing, comprises the following steps:

inserting the mounting sleeve in a mounting opening; inserting a person's hand into the luminaire housing and moving the handles towards each other so as to transfer the locking elements to a release position; introducing the luminaire housing into the mounting sleeve until the support edge of the luminaire housing comes into abutting contact with the contact portion of the mounting sleeve; releasing the handles so as to transfer the locking elements to a fixing position on the contact portion of the mounting sleeve.

BRIEF DESCRIPTION OF THE DRAWINGS

In the following, an embodiment of the present invention will be explained in more detail making reference to the drawings enclosed, in which.

DETAILED DESCRIPTION

Figure 1:
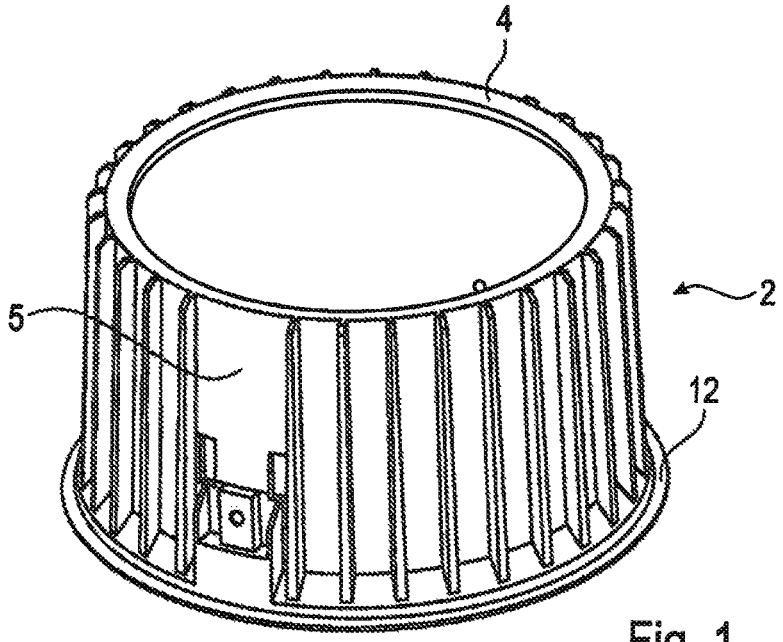
FIG. 1 shows a three-dimensional representation of a mounting sleeve according to the present invention.

In the figures following hereinafter, all identical components will be identified by identical reference numerals. Furthermore, in the figures showing the mode of operation of the locking elements in more detail, a respective locking element is shown in the retracted position (release position) and an opposite locking element is shown in the extended position (fixing position). This only serves to explain the mode of operation of the locking element. When in use, both locking elements are moved simultaneously either to the release position or to the fixing position.

In FIG. 1, a mounting sleeve according to the present invention is shown, which is used for overmount fitting on the building structure. The mounting sleeve comprises a circumferentially extending wall 5 formed with contact portions 4, 12 on both end edges thereof. One contact portion 4 extends into the interior of the mounting sleeve, whereas the opposite contact portion 12 extends externally along the circumference of the mounting sleeve 2. Contact portion 12 serves as a support edge on the building structure when the luminaire is in use, and contact portion 4 configured substantially parallel to said contact portion 12 cooperates, during the mounting process, with the luminaire housing 3 to be installed.

The outer surface of the mounting sleeve 2 may by configured in an arbitrary manner, in the present case with cross ribs. Furthermore, mounting positions 13 may be provided for arranging additional gripping elements, e.g. spring elements.

Figure 2:
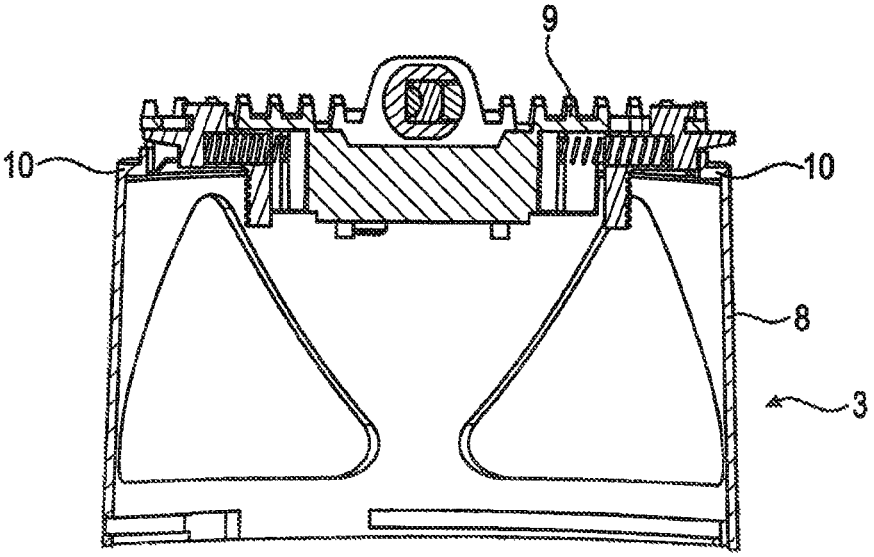
FIG. 2 shows a section through a luminaire housing according to the present invention.

FIG. 2 shows a section through a luminaire housing according to the present invention. The luminaire housing may have an external diameter, which does not vary over the entire height of the housing, or the external diameter may decrease towards the top, i.e. towards a cover. In more detail, the luminaire housing comprises a circumferentially extending wall 8 and a cover portion 9, which is arranged on the wall 8. The wall 8 and the cover portion 9 are here preferably formed integrally with each other, the external diameter of the cover portion being, however, smaller than that of the wall in the area where the wall 8 merges with the cover portion 9. Due to these different diameters, a circumferentially extending support portion 10 is formed between the cover portion 9 and the wall 8. In addition, ribs extending parallel to one another may be arranged on the upper or outer surface of the cover portion 9.

In the area of the lateral wall of the cover portion 9, lateral openings 14 are formed, which are arranged in predetermined spaced-apart relationship with the support portion 10.

Furthermore, the interior of the luminaire housing 3 has provided therein connections for the optical elements on the one hand, and movably configured locking elements 6 on the other. The locking elements 6 may here extend sectionwise through the lateral openings 14 to the exterior of the luminaire housing 3. These locking elements 6 are arranged in the area of the cover portion 9 and are shown in more detail, in the disassembled condition, in FIGS. 3*a* and 3*b*.

Figure 3A:
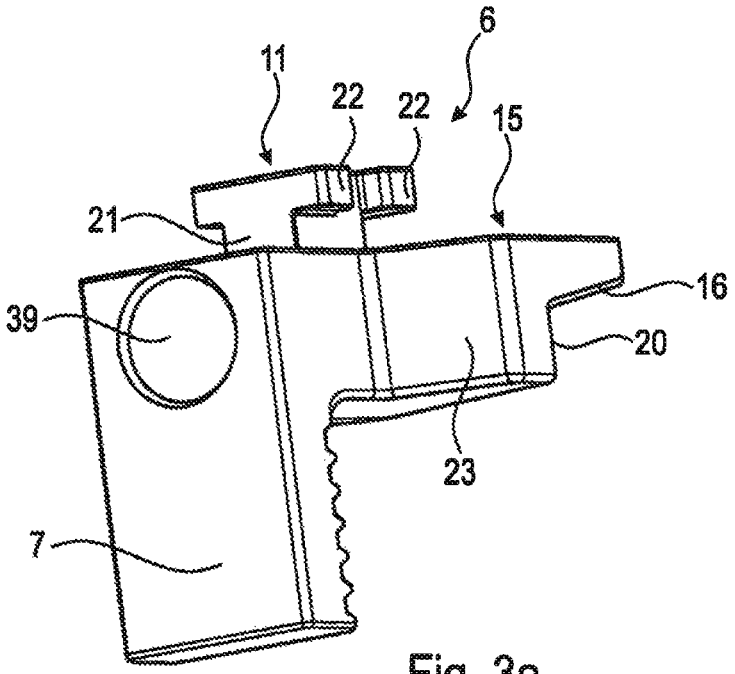
FIGS. 3*a* and 3*b* show, at an oblique angle from above and at an oblique angle from below, a three-dimensional representation of the locking element provided in the luminaire housing
Figure 3B:
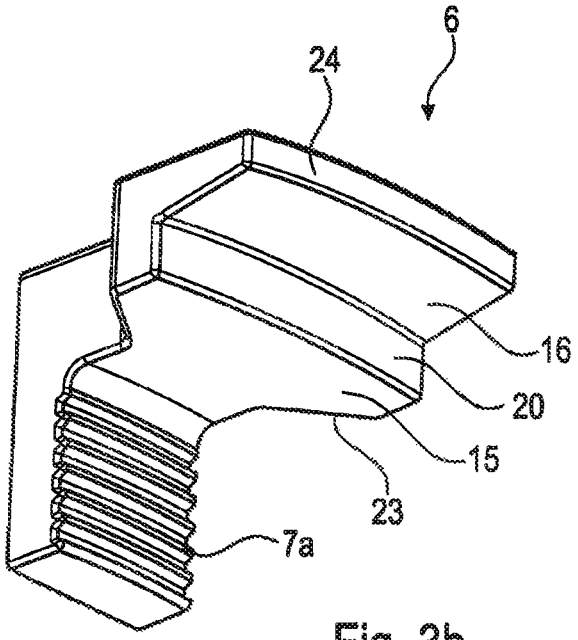

FIG. 3*a* shows here a locking element 6, in the case of which especially the back and a lateral surface are visible, the locking element being shown in an oblique view. FIG. 3*b* shows the locking element at an oblique angle from below, the focus of the representation being the surface facing the luminaire housing, i.e. the front side. Each locking element is configured as an angular element comprising two sections, which are spaced apart at right angles and formed integrally with each other at right angles. One of these elements defines here the handle 7, which, as shown in FIG. 2, extends perpendicular to the cover portion 9 into the interior of the luminaire housing 3. The handle may have formed thereon a gripping surface 7*a* on one side thereof, i.e. on the side facing the inner side of the luminaire housing, said gripping surface 7*a* comprising e.g. grooves that extend parallel to one another. When the handle is in use, this is the area that is gripped by the user's hand, i.e. by operating the handles 7 the locking elements 6 can be moved to a fixing position or release position.

The handle 7 is followed by a locking portion 15, which, as shown in FIG. 2, is arranged parallel to the cover portion 9. The locking portion 15 is configured as a step element comprising lateral steps and being also stepped in a height direction, i.e. the locking portion 15 initially has the width of the handle 7 and, starting from this width, it widens until it has reached a final width. The width may here change gradually, or an oblique transition area 23 may be formed, which equalizes the transition between the initial and the final width. The width of the end surface 24 is here at least twice as large as the width of the gripping surface 7*a*. The end surface 24 is here the surface with which the locking portion 15 is passed through the lateral opening 14 of the luminaire housing.

The upper side of the locking portion 15, which follows the end surface 24, is straight, whereas the lower side 26 thereof, i.e. the side facing the luminaire housing 3, is configured as a tapering surface 16, so that the locking portion 15 has the smallest thickness in the area of the end surface 24. Starting from the end surface 24, the tapering surface 16 extends under a predetermined angle downwards. Due to the oblique tapering surface 16, these surfaces can, when the locking elements 6 are being extended, build up axial forces relative to the mounting sleeve according to the wedge principle. These forces lead to an axial tension in the mounted system. This tension guarantees a rattle-free end position of the luminaire. The angle of the wedge is here chosen sufficiently small for ensuring a self-locking effect of the mechanism, i.e. the luminaire's own weight cannot cause a retraction of the locking elements. It follows that the luminaire is fixed in position by a mixture of force-fit and form-fit connection.

The tapering surface 16 is followed by a stop shoulder 20, said stop shoulder being configured such that it extends substantially perpendicularly downwards. By means of this stop shoulder 20, it is determined to what extent the locking portion is allowed to pass through the lateral opening 14 to the exterior of the luminaire housing 3, i.e. the locking elements 6 can only be displaced outwards in the direction of the luminaire housing until the stop shoulder 20 comes into abutting contact with the inner surface of the luminaire housing.

Figure 5:
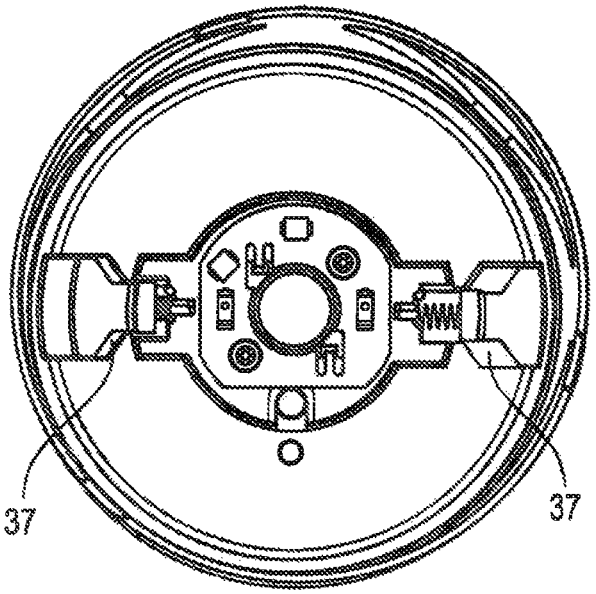
FIG. 5 shows a view of the interior of the luminaire housing, in particular of the cover portion.

As can clearly be seen in FIG. 3*a*, the back of the locking portion 15, i.e. the extension of the handle 7, has formed therein a blind hole 39, which serves to accommodate a spiral spring 38. The arrangement of the spiral spring is shown in FIG. 2 as well as in FIG. 5. The depth of the blind hole is sufficiently large for guaranteeing that the compressed spiral spring 38 can fully be accommodated therein during the mounting process.

Furthermore, the locking element 6 is provided with a sliding section 11 on its upper side, i.e. the side located opposite the cover portion 9. As can be seen in FIG. 3*a*, this sliding section 11 is T-shaped, with a web 21 extending upwards from the upper surface of the locking portion and with sliding fingers 22 following said web 21. The sliding fingers 22 are here spaced apart from the upper side of the locking portion 15 by a predetermined vertical distance, determined by the height of the web 21. As shown in FIG. 3*a*, individual spaced-apart sliding fingers 22 may be provided, or the sliding fingers 22 provided may extend across the whole width of the web 21.

As can be seen in FIG. 2, the locking elements 6 abut on the lower surface of the cover portion 9 when the luminaire is in use, said lower surface of the cover portion 9 having recesses 37 formed therein for accommodating the locking elements 6. These recesses are configured as depressions having the shape of the locking elements and allow the locking elements 6 to move unhindered between the fixing position and the release position. These depressions 37 also act as a guide for the locking elements.

As has already been stated, the luminaire housing 3 is provided with openings 14 arranged laterally in the area of the cover element 9 and used for passing the locking elements 6 therethrough, said openings 14 being formed in predetermined spaced-apart relationship with the support portion 10. This guarantees that the locking elements 6 can be passed sectionwise through the cover element 9.

In addition, the cover portion 9 has formed therein sliding apertures 17, which extend from a lower side of the cover portion 9 to an upper or outer side of the cover portion 9. These apertures 17 serve as sliding guides for the locking elements 6 and allow, on the one hand, the sliding sections 11 of the locking elements to pass therethrough up to a level above the outer side of the cover portion 9 and, on the other hand, they provide guidance for this sliding section in the area of the web elements 21.

Figure 4:
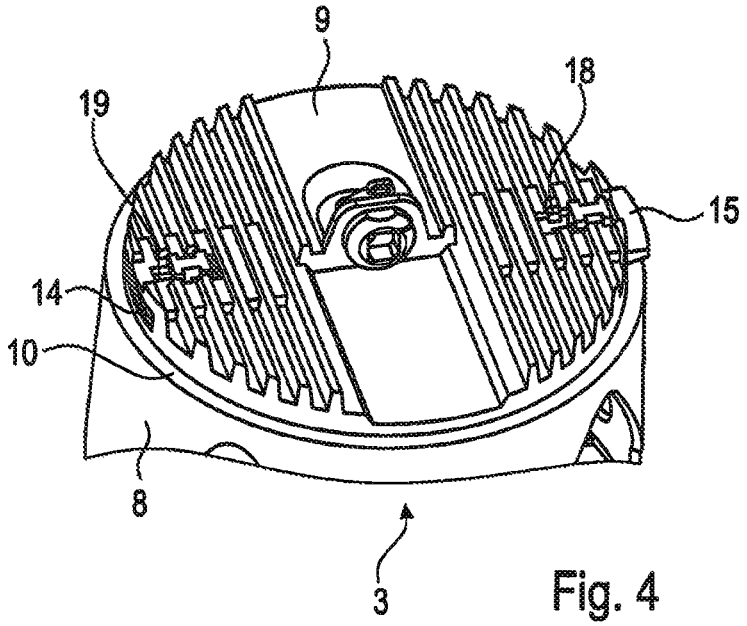
FIG. 4 shows a three-dimensional top view of the upper side of the luminaire housing.

In more detail, the sliding apertures 17 extend from a position located closer to a center of the cover portion outwards in the direction of the outer edge. The sliding apertures 17 comprise a passage opening 18 of increased width as well as a slide channel 19 adjoining said passage opening 18. The respective passage openings 18 are here arranged in a central area of the cover portion and correspond in shape to the surface of the sliding section 11 of the locking element 6. Starting from this passage opening 18, the slide channel 19 then extends along a straight line up to the outer edge of the cover portion 9 and ends at a predetermined distance from the latter. Preferably, the slide channel ends at a predetermined position thus providing the stop for the web 21 of the sliding section 11, which corresponds to the stop of the stop shoulder 20 on the inner side of the luminaire housing 3. A sliding guide 17 of the type in question is shown e.g. in FIG. 4.

In the installed condition, the sliding section 11 is guided through the passage opening 18 in the area of the cover portion 9, so that the sliding fingers 22 are arranged above the outer side of the cover portion 9. By displacing the locking elements 6 outwards, the sliding section 11 is guided out of the passage opening 18 in the area of the slide channel 19, whereupon the sliding fingers fully rest on the outer side of the cover portion 9 on either side of the slide channel 19. In this respect, the use of individual sliding fingers 22 proved to be particularly expedient, since this has the effect that, when the locking element 6 is being displaced, a support surface for the sliding fingers 22 will be provided, at least sectionwise, also in the area of the passage opening 18.

Hence, the locking element 6 is held from the inner as well as from the outer side of the cover portion 9 and is thus secured in position on the luminaire housing. The locking element 6 is additionally held by the spiral spring 38, which is accommodated in the blind hole 39 on the back of the locking element 6 and which extends from said recess into the luminaire housing and is there fixed in position. Only during mounting of the locking element 6, the spring is fully hidden in the recess and it is only set free when the mounting process has been finished, whereby the spiral spring will expand. In this condition, the spiral spring can no longer be removed without making use of suitable disassembly devices.

When the luminaire housing 3 has been mounted in the interior of the mounting sleeve 2, the support portion 10 of the luminaire housing 3 abuts on the inner side of the contact portion 4, while a portion of the locking element 6 extends through the lateral opening 14 so as to cooperate with the outer side of the contact portion 4 for fixing the luminaire housing 3 to the mounting sleeve 2. The locking element is here pressed into the outermost position by the spiral spring and prevents unintentional dismounting of the locking elements.

In the following, the assembly of an assembly set according to the present invention in the building structure will be explained briefly for three different types of mounting. This may be mounting in round openings of drywall elements, frameless mounting in drywall ceilings or the use of the assembly set in cast walls, floors or ceilings. The assembly sets according to the present invention differ here with respect to the structural design of the mounting sleeve, which is adapted to the respective demands to be satisfied.

Figure 6:
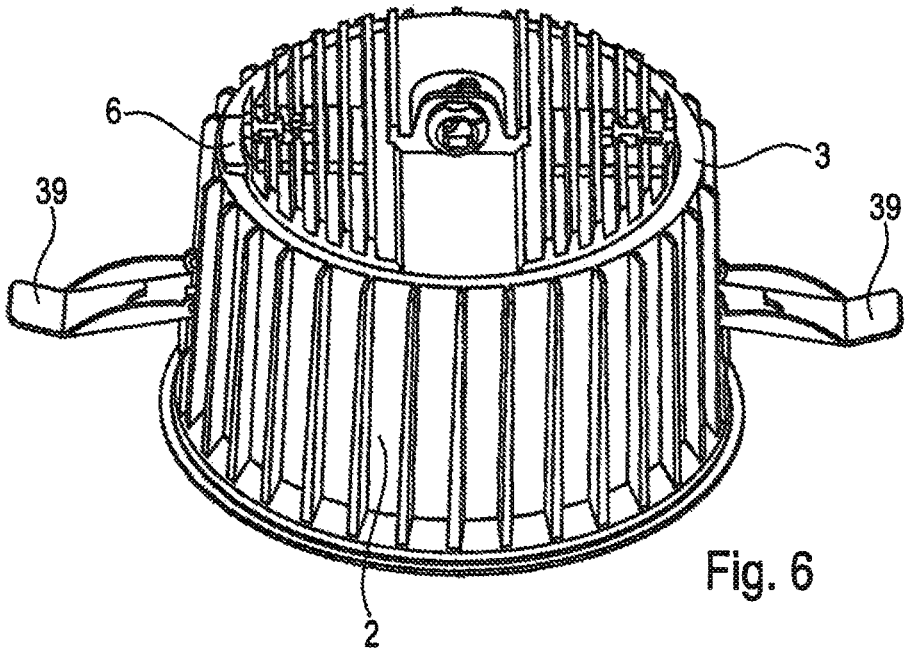
FIG. 6 shows the mounting sleeve according to the present invention depicted in FIG. 1, having the luminaire housing installed therein, shown for overmount fitting.

For mounting in openings of drywall elements, an over-mount-type mounting sleeve is used. As has already been explained in connection with FIG. 1 and as is additionally shown in FIG. 6, a mounting sleeve 2 of the type in question has a lower support edge 12, which is fixed in position in the opening of the building structure by folding springs 39, in that the springs draw the edge of the sleeve from inside against the building structure. On the mounting sleeve side located opposite the opening of the building structure, the inwardly extending contact portion 4 is arranged, as has already been described. When the mounting sleeve 2 has been mounted, the luminaire housing 3 can easily be installed in the mounting sleeve 2. If the optical elements are arranged in the luminaire housing 3, they will have to be removed from the luminaire housing 3 in advance. Subsequently, the fitter can insert his hand into the luminaire housing until he reaches the handles 7, preferably with his thumb and his forefinger. By compressing the handles 7 of the locking elements 6, the locking element portions extending above the support portion 10 through the luminaire housing 3 are displaced inwards, i.e. into the interior of the luminaire housing 3, and the luminaire housing 3 can be inserted into the mounting sleeve 2 all the way to the stop. This stop is provided by the contact portion 4 of the mounting sleeve 2. The outer surface of the support portion 10 comes into abutting contact with the inwardly directed side of the contact portion 4. During this entire process, the handles 7 are pressed together. When the luminaire housing has been introduced in the sleeve all the way to the stop, the handles can be released, whereby the locking elements 6 will return to the fixing position, i.e. the outer portions of the locking elements 6 will pass again through the lateral openings 14 and then act on the outer side of the contact portion 4 of the mounting sleeve 2. The contact portion 4 is thus fixed between the support portion 10 and the locking element 6. Subsequently, the optical elements can be installed and the luminaire will be ready for use.

Figure 7:
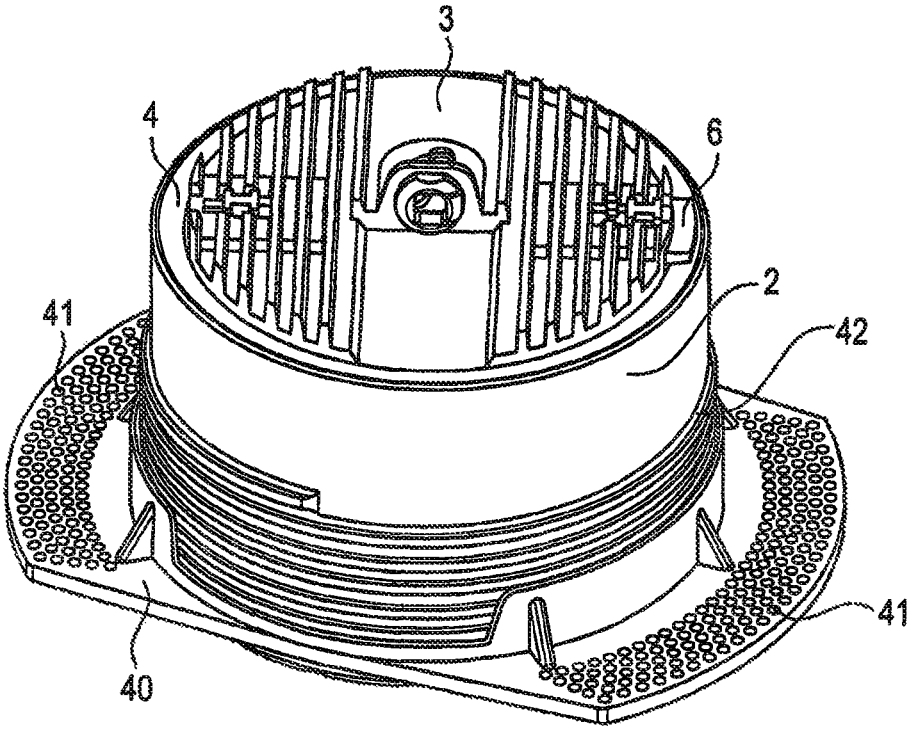
FIG. 7 shows a mounting sleeve configured for frameless mounting, comprising a base element and having the luminaire housing installed therein.

Another mounting possibility is frameless mounting in drywall ceilings, as shown e.g. in FIG. 7. In this case, a basic element 40 is first arranged on the back of the ceiling or of the wall through a previously provided opening. The basic element 40 is normally provided on two sides thereof with perforated plates 41. These plates can be screw-fastened by means of drywall screws to the drywall board from the side of the room. After such fixing, a mounting sleeve 2 can be installed in the basic element 40. In this case, the mounting sleeve 2 is normally configured as an adjustment sleeve having an external thread 42 that can be screwed into a mating internal thread of the basic element. Through a screwing movement of the adjustment sleeve, the arrangement can then be adjusted to the respective thickness of the boards used. Subsequently, the gap between the sleeve and the board can be filled. The sleeve may here be provided with teeth on the outer surface thereof, so as to realize good contact with the filler. When the filler has hardened, the mounting sleeve will be a permanent component part of the building structure, which can no longer be removed. An easy mounting base for the luminaire is thus formed. Since the adjustment sleeve is here the mounting sleeve, the contact portion 4 is also in this case formed in the interior thereof. The luminaire housing 3 is installed in the way that has already been described hereinbefore. A luminaire installed in this way, is arranged fully within the building structure and is flush with the lower surface of the ceiling.

Furthermore, an assembly set according to the present invention may also be used in cast walls, floors and ceilings. In this case, an installation housing is used as a mounting sleeve, said installation housing being fixed in position on the formwork thus creating a cavity within the concrete construction of a building. The interior of this installation housing has again provided therein the contact portion 4 for the locking elements. Its position is dimensioned such that, after having been installed, the luminaire will again extend parallel to the building structure surface and the luminaire will thus be hidden in the ceiling. When the luminaire housing has been locked in position by releasing the locking elements 6, the optical elements are installed in the luminaire, whereby the mounting process is finished. Disassembly of the luminaire housing will no longer be possible, without opening the luminaire again, i.e. without removing the optical elements.

The invention claimed is:

1. An assembly set for recessed ceiling and wall luminaires, comprising a mounting sleeve and a luminaire housing, which is adapted to be installed in the mounting sleeve, said mounting sleeve being mountable in a wall or ceiling opening, wherein the mounting sleeve is provided with contact portions extending, on the side of the mounting sleeve facing away from the wall or ceiling opening, perpendicular to a wall of said mounting sleeve into the interior of the mounting sleeve, the luminaire housing comprises at least two locking elements extending beyond the circumference of the luminaire housing, wherein the locking elements of the luminaire housing engage behind the contact portions of the mounting sleeve at the fixing position, and the locking elements are operatively connected to handles in the interior of the luminaire housing such that the locking elements can be transferred from the fixing position to a release position by moving the handles towards each other.

2. The assembly set for recessed ceiling and wall luminaires according to claim 1, wherein the locking elements are displaceably arranged in the luminaire housing.

3. The assembly set for recessed ceiling and wall luminaires according to claim 1, wherein the luminaire housing comprises a circumferentially extending wall portion as well as a cover portion, said cover portion extending beyond the wall portion thus forming a support portion, and lateral openings being formed in the area of the cover portion at a predetermined distance from the support portion, the locking elements, when occupying the fixing position, extending through said lateral openings, at least sectionwise.

4. The assembly set for recessed ceiling and wall luminaires according to claim 3, wherein the predetermined distance between the support portion and the lateral opening corresponds to the thickness of the contact portion of the mounting sleeve.

5. The assembly set for recessed ceiling and wall luminaires according to claim 2, wherein, in the area of the cover portion, an upper sliding aperture is formed for each locking element, each locking element comprising a sliding section which extends from inside through the sliding aperture to the outside of the cover portion.

6. The assembly set for recessed ceiling and wall luminaires according to claim 5, wherein the sliding section is configured as a T-shaped element on the side of the locking element located opposite to the handles, said T-shaped element comprising a web element and sliding fingers extending from opposed sides of said web element.

7. The assembly set for recessed ceiling and wall luminaires according to claim 4, wherein the sliding apertures are formed at a position close to the center of the cover portion in the form of a passage opening (and extend in the direction of an outer edge of the cover portion as a slide channel.

8. The assembly set for recessed ceiling and wall luminaires according to claim 7, wherein the sliding fingers are displaceably arranged on either side of the slide channel on the outer side of the cover portion.

9. The assembly set for recessed ceiling and wall luminaires according to claim 2, wherein sliding recesses for the locking elements are formed on the inner side of the cover portion, the locking elements being movable between the fixing position and the release position in said sliding recesses.

10. The assembly set for recessed ceiling and wall luminaires according to claim 9, wherein the sliding recess is configured with a depth of such a nature that it corresponds to a size of the lateral openings facing the upper side of the cover element.

11. The assembly set for recessed ceiling and wall luminaires according to claim 3, wherein the areas of each locking element extending through the lateral opening are wedge-shaped, the surface facing the support edge extending at an oblique angle upwards in the direction of an outer edge of the locking element.

12. The assembly set for recessed ceiling and wall luminaires according to claim 11, wherein a downwardly extending stop shoulder follows the wedge-shaped area of the locking element, said stop shoulder being adapted to be brought into abutting contact with the inner side of the luminaire housing below the lateral opening.

13. The assembly set for recessed ceiling and wall luminaires according to claim 1, wherein the each locking element is biased at the fixing position.

14. The assembly set for recessed ceiling and wall luminaires according to claim 13, wherein the locking element is biased via a spring element.

15. The assembly set for recessed ceiling and wall luminaires according to claim 13, wherein each locking element has, on the surfaces facing each other, accommodation sections for fully accommodating therein the spring element in the compressed condition and for partially accommodating therein the spring element in the relaxed condition.

16. The assembly set for recessed ceiling and wall luminaires according to claim 15, wherein the accommodation section is configured as a blind hole.

17. The assembly set for recessed ceiling and wall luminaires according to claim 1, wherein the width of each locking element increases in the direction of the inner side of the luminaire housing.

18. The assembly set for recessed ceiling and wall luminaires according to claim 1, wherein two locking elements are provided.

19. The assembly set for recessed ceiling and wall luminaires according to claim 3, wherein those areas of the contact portion of the mounting sleeve and of the support portion of the luminaire housing which are arranged one on top of the other in the assembled condition are provided with teeth.

20. The assembly set for recessed ceiling and wall luminaires according to claim 3, wherein a sealing element is arranged between those areas of the contact portion of the mounting sleeve and of the support portion of the luminaire housing which are arranged one on top of the other in the assembled condition.

21. The assembly set for recessed ceiling and wall luminaires according to claim 1, wherein the mounting sleeve is provided with additional elements, selected from mounting elements and/or an external thread, on its outer side, in particular on the side of the outer side facing a building structure.

22. A method for fixing an assembly set for recessed ceiling and wall luminaires in a wall or ceiling opening, wherein the assembly comprises a mounting sleeve and a luminaire housing, which is adapted to be installed in the mounting sleeve, the mounting sleeve is provided with contact portions extending, on the side of the mounting sleeve facing away from the wall or ceiling opening, perpendicular to a wall of said mounting sleeve into the interior of the mounting sleeve, the luminaire housing comprises at least two locking elements which extend beyond the circumference of the luminaire housing and which are operatively connected to handles in the interior of the luminaire housing, said method comprising the following steps:

inserting the mounting sleeve in a mounting opening;

inserting a person's hand into the luminaire housing and moving the handles towards each other so as to transfer the locking elements to a release position;

introducing the luminaire housing into the mounting sleeve until the support edge of the luminaire housing comes into abutting contact with the contact portion of the mounting sleeve;

releasing the handles so as to transfer the locking elements to a fixing position on the contact portion of the mounting sleeve.

* * * * *